US012378759B2

(12) United States Patent
Bontomase et al.

(10) Patent No.: US 12,378,759 B2
(45) Date of Patent: Aug. 5, 2025

(54) INTERIOR CONSTRUCTION STRUCTURES AND SYSTEMS

(71) Applicants: Anthony Roman Bontomase, Stirling, NJ (US); Matthew Damer Lammers, Portland, OR (US); Alexander Compagno, New York, NY (US); Ariadne Kaptur, New York, NY (US); Xianzhang Chen, New York, NY (US); Kyle Feeney, Greenwich, CT (US)

(72) Inventors: Anthony Roman Bontomase, Stirling, NJ (US); Matthew Damer Lammers, Portland, OR (US); Alexander Compagno, New York, NY (US); Ariadne Kaptur, New York, NY (US); Xianzhang Chen, New York, NY (US); Kyle Feeney, Greenwich, CT (US)

( * ) Notice: Subject to any disclaimer, the term of this patent is extended or adjusted under 35 U.S.C. 154(b) by 404 days.

(21) Appl. No.: 17/579,107

(22) Filed: Jan. 19, 2022

(65) Prior Publication Data

US 2022/0228358 A1 Jul. 21, 2022

Related U.S. Application Data

(60) Provisional application No. 63/139,284, filed on Jan. 19, 2021.

(51) Int. Cl.
*E04B 1/18* (2006.01)
*E04B 1/98* (2006.01)

(52) U.S. Cl.
CPC . *E04B 1/18* (2013.01); *E04B 1/98* (2013.01)

(58) Field of Classification Search
CPC ..... E04B 1/18; E04B 1/98; E04B 2009/186; E04B 2/7405; E04B 9/001; E04B 9/008; E04B 2/7403
See application file for complete search history.

(56) References Cited

U.S. PATENT DOCUMENTS 2,499,498 A * 3/1950 Hammond, Jr. ..... E04H 1/005 414/277
3,623,296 A * 11/1971 Santoro ..... E04B 1/34807 D25/4
3,638,380 A * 2/1972 Perri ..... E04B 1/34807 52/79.12
6,874,283 B1 * 4/2005 Hindle ..... E04B 1/3431 296/26.14
9,617,748 B2 * 4/2017 Wilson ..... E04B 1/34336
10,323,432 B2 * 6/2019 Davis ..... B65G 1/0464
(Continued)

FOREIGN PATENT DOCUMENTS

FR 2175624 A1 * 3/1972

*Primary Examiner* — Babajide A Demuren
(74) *Attorney, Agent, or Firm* — MCDONNELL BOEHNEN HULBERT & BERGHOFF LLP

(57) ABSTRACT

An interior building structure is provided and comprises a plurality of side walls, each comprising an exterior surface, an interior surface, a bottom end, and a top end opposite the bottom end, the bottom end being connected to a lower base building slab of the base building and the top end being free. A lateral support structure is further provided that extends from a first wall to a second wall of the plurality of side walls. Airspace portions are formed from gaps between the side walls and the base building structure, decoupling the walls of the interior building structure from the base building structure.

16 Claims, 4 Drawing Sheets

(56) References Cited

U.S. PATENT DOCUMENTS

| | | | | |
|---|---|---|---|---|
| 10,392,795 | B2 * | 8/2019 | Tsai | E04B 1/343 |
| 10,711,476 | B2 * | 7/2020 | Ansari | E04B 1/34807 |
| 2006/0101727 | A1 * | 5/2006 | Holgerson | A62C 99/0081 52/79.1 |
| 2020/0378108 | A1 * | 12/2020 | Ballew | E04H 1/005 |

* cited by examiner

INTERIOR CONSTRUCTION STRUCTURES AND SYSTEMS

CROSS REFERENCE TO RELATED APPLICATION

This application claims priority to and the benefit of U.S. Provisional Application Ser. No. 63/139,284 filed Jan. 19, 2021, the entire contents of which are incorporated herein by reference.

BACKGROUND

As global wealth, construction technologies, and urban real estate prices advance, so do the design and construction of taller, more slender building structures. These building structures are designed to accommodate wind events and remain safe with differential displacements of more than several feet from the base of the building to the top floor.

Inter-story displacements or drift are displacements between adjacent building levels, and are generally small displacements, for example as small as 0.5 inches or less. Yet inter-story displacements generate stresses and strains on interior constructions, which are commonly attached to both a lower and upper reinforced concrete or concrete on composite metal "base" floor slab. This differential movement and the resulting stresses in the interior framing steel and drywall create popping and creaking sounds that can be disturbing in both residential and commercial applications.

Many buildings employ a tuned mass damper (TMD) to reduce building movement in a wind event and to prevent structural failures in earthquakes. However, buildings with TMDs will still sway and create significant and disruptive inter-story displacements, which translate to the interior constructions within the building.

In order to avoid the vertical and horizontal stresses and strains on interior construction drywall partitions due to inter-story displacement, a variety of products claim to achieve flexibility and allow movement between floor slabs. Typically, this is accomplished using a slotted steel track or steel angle braces and resilient padding. However, it has been shown that these products do not provide adequate flexibility of movements and the stress and strain on wall still generates popping and creaking sounds, as well as visible cracking in the interior construction finishes.

SUMMARY

In accordance with the present invention, interior construction systems and structures are defined to mitigate noise and cracking caused by inter-story drift.

In one example embodiment, an interior building structure comprises a plurality of side walls, each of the plurality of side walls comprising an exterior surface, an interior surface, a bottom end, and a top end opposite the bottom end, the bottom end being connected to a lower base building slab of the base building and the top end being free. A lateral support structure, comprising a joist structure having at least one lateral support extends between two of the plurality of sidewalls.

The structure further comprises airspace portions located between the exterior surface of the plurality of side walls and bases wall of a building.

These as well as other aspects and advantages of the synergy achieved by combining the various aspects of this construction method, that while not previously disclosed, will become apparent to those of ordinary skill in the art by reading the following detailed description, with reference where appropriate to the accompanying drawings.

DETAILED DESCRIPTION

In the following detailed description, reference is made to the accompanying figures, which form a part thereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein. Unless otherwise defined, the technical terms used herein have the same meaning as commonly understood by one of ordinary skill in the art.

The present disclosure provides an interior construction assembly that alleviates noise and stresses that are created by inter-story differential movements between building floors. To this end, the present disclosure comprises a decoupled interior construction assembly and structure for interior framing or construction of partitions and ceilings to significantly reduce effects created from inter-story displacement. The construction assembly also provides cosmetic benefits, such as preventing or reducing the prevalence of cracks in wall finishes and ceilings.

The present disclosure disconnects or decouples the interior framing of walls from a floor slab above, also referred to as the upper floor slab or upper base building slab, and slabs along the sides. Thus, contact between the interior framing of walls from the upper base building slab and sidewall slabs is eliminated, resulting in an interior construction structure that provides adequate flexibility of movements during movement of the building. While other constructions attempt to provide a structure having the ability to move as the building moves, they ultimately do not adequately free the structure from the base building, and thus do not eliminate the stress or strain on the structure.

The constructions and methods described herein include decoupling wall structures from an upper floor slab and side slabs and building a free-standing, five-sided framed structure supported only from the lower base building slab.

Figure 1:
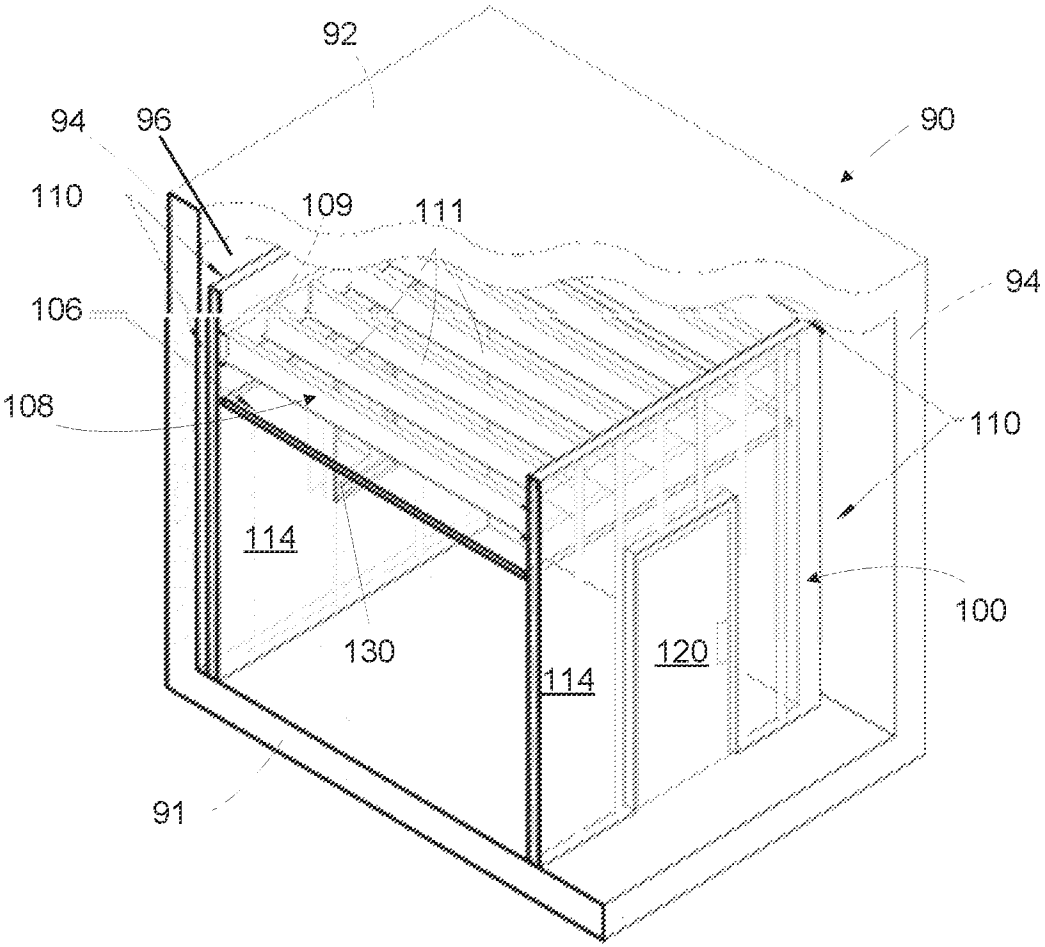
FIG. 1 depicts an isometric view of an interior building construction assembly within a base building structure, in accordance with at least one example embodiment.

Turning to the figures, FIG. 1 depicts an isometric view of an interior building construction assembly 100 within a base building structure 90, in accordance with at least one example embodiment.

As shown in FIG. 1, a base building structure 90 comprises a lower base building slab 91, an upper base building slab 92, and a plurality of base building walls 94. The construction assembly 100 within the base building structure 90 comprises a finish ceiling 106, a lateral support or joist structure 108, and a plurality of stud walls 114. A plurality of airspace portions 110 are formed between the base building structure 90 and the construction assembly 100, as will be described in further detail below.

The lower base building slab 91 and the upper base building slab 92, along with the base building walls 94, form the base structure of a building. In some examples, the lower base building slab 91 and the upper base building slab 92 may each comprise a precast concrete slab or plank, concrete placed on metal decking, or cast-in-place concrete. The base building walls 94 each include an exterior surface and an interior surface. The sizing of the base building structure 90 may vary widely, depending on the design of the building. The structures for the building construction assembly 100 described herein are designed and sized to fit within and address the size of the base building structure 90 that is already present upon completion of construction of the building.

In the isometric view of FIG. 1, two base building walls 94 are shown; another two base building walls 94 are generally present so as to form an enclosure when combined with the lower base building slab 91 and the upper base building slab 92, defining an interior chamber 96. Within the interior chamber 96 resides the construction assembly 100.

The stud walls 114 of the construction assembly 100 may comprise four vertical walls, each having a bottom end and a top end opposite the bottom end, the bottom end being connected to the lower building slab 91 and the top end being free. The stud walls 114 may be formed from metal or wood studs with gypsum wall board, for example. In the isometric views of FIGS. 1-2, three stud walls 114 are shown. Access features such as doorways 120 and windows 130, may extend through the stud walls 114 to provide access into the construction assembly 100.

The construction assembly 100 also comprises the finish ceiling 106, which is positioned above the lower base building slab 91, and positioned above the finish ceiling 106 is the joist structure 108.

The joist structure 108 may comprise a frame 109 that holds a plurality of joists 111 that extend across the frame. In some embodiments, the joist structure 108 may be formed from metal, wood, or a composite material. The joist structure 108 provides for lateral stability since the stud walls 114 do not contact the upper base building slab 92.

The lateral support or joist structure 108 is affixed to and supported off of one or more of the stud walls 114. The joist structure 108 does not contact the upper base building slab 92, nor the base building walls 94. Although joists are disclosed, any lateral support element may form the lateral support structure.

In one example embodiment, the finish ceiling 106 hangs from the upper base building slab 92, without any contact with the stud walls 114 or the joist structure 108. An air gap may be maintained between edges of the finish ceiling 106 and the interior surfaces of the stud walls 114 to avoid contact between the finish ceiling 106 and the stud walls 114. The finish ceiling 106 may be suspended with threaded rods, pencil rods, wire hangers, or the like, wherein these suspension elements extend through gaps between the plurality of joists 111. The finish ceiling 106 may comprise drywall or another interior finish ceiling structure, in some embodiments.

In another example embodiment, the finish ceiling 106 is not attached to the upper base building slab 92, but is instead attached to one or more of the interior surfaces of the stud walls 114 and/or the joist structure 108.

The stud walls 114 may be connected to the lower base building slab 91 only, and be positioned a distance from the base building walls 94 and the upper base building slab 92 such that there is no contact between the base building walls 94, the upper base building slab 92, and the stud walls 114.

Lateral support for the stud walls 114 is provided via the plurality of joists 111 and possibly also via diagonal strapping to connect the walls. Depending on the building façade system and other structural elements, specialty reveal details may be required to maintain flexible connection to the exterior system or interior columns and structural members.

The airspace portions 110, which may also be referred to as unbridged airspace or unbridged voids, are formed by the distance from the base building and the interior construction assembly, comprising portions or regions located between the base building structure 90 and the construction assembly 100. In some embodiments, the airspace portions 110 form a width about 1 inch from the exterior surface of the stud walls 114 to the interior surface of the base building walls 94 or slab 92. In certain embodiments, the airspace portions 110 may comprise a width ranging from 0.5 inches to 10 inches or more.

One airspace portion 110 may be provided between the top surface of the stud walls 114 or the joist structure 108 and the upper base building slab 92 above. Thus, there may be no connection between the stud walls 114 or the ceiling structure (comprising the finish ceiling 106 and the joist structure 108) and the upper base building slab 92; these would be decoupled from each other. Alternately, as shown in FIG. 4, the finish ceiling 106 may be suspended from the upper base building slab 92 without connection to the joist structure 108 or the stud walls 114.

Figure 2:
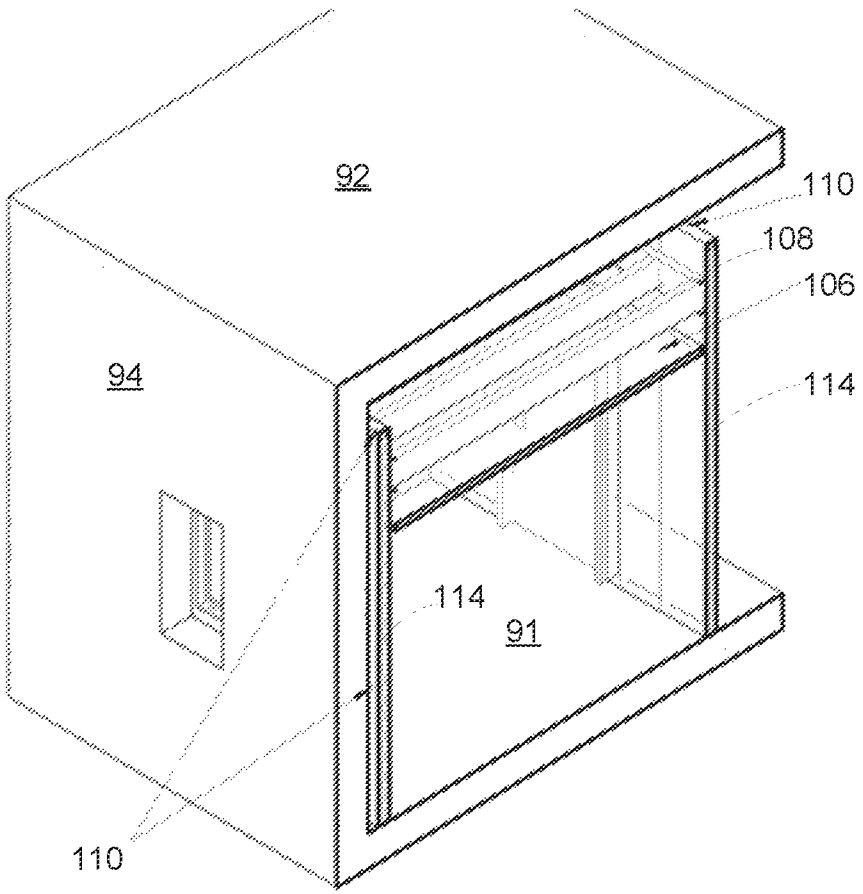
FIG. 2 depicts an isometric view of the construction assembly of FIG. 1, in accordance with at least one example embodiment.
Figure 3:
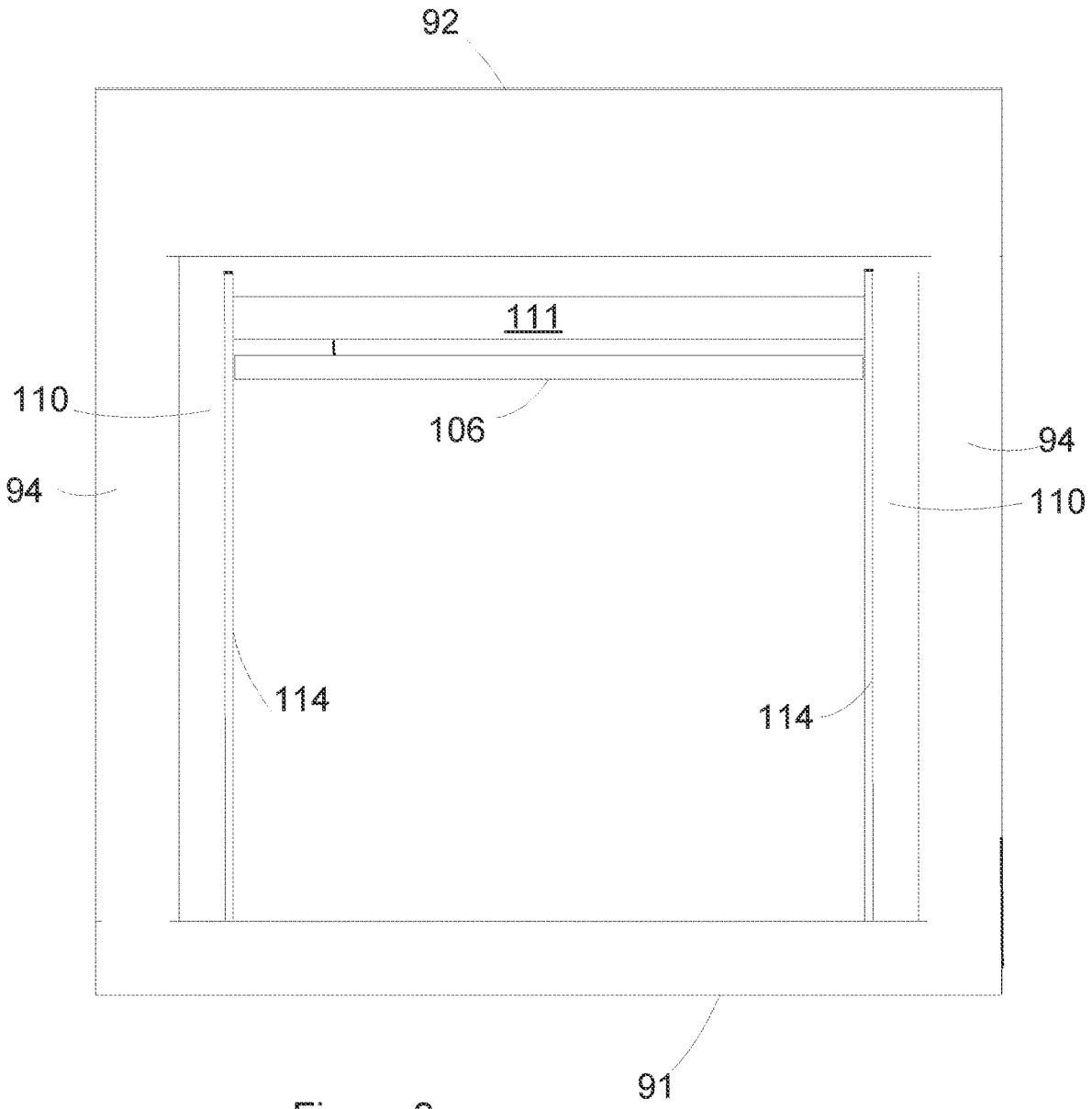
FIG. 3 depicts a front view of an interior building construction assembly such as the construction assembly of FIG. 1, in accordance with at least one example embodiment.
Figure 4:
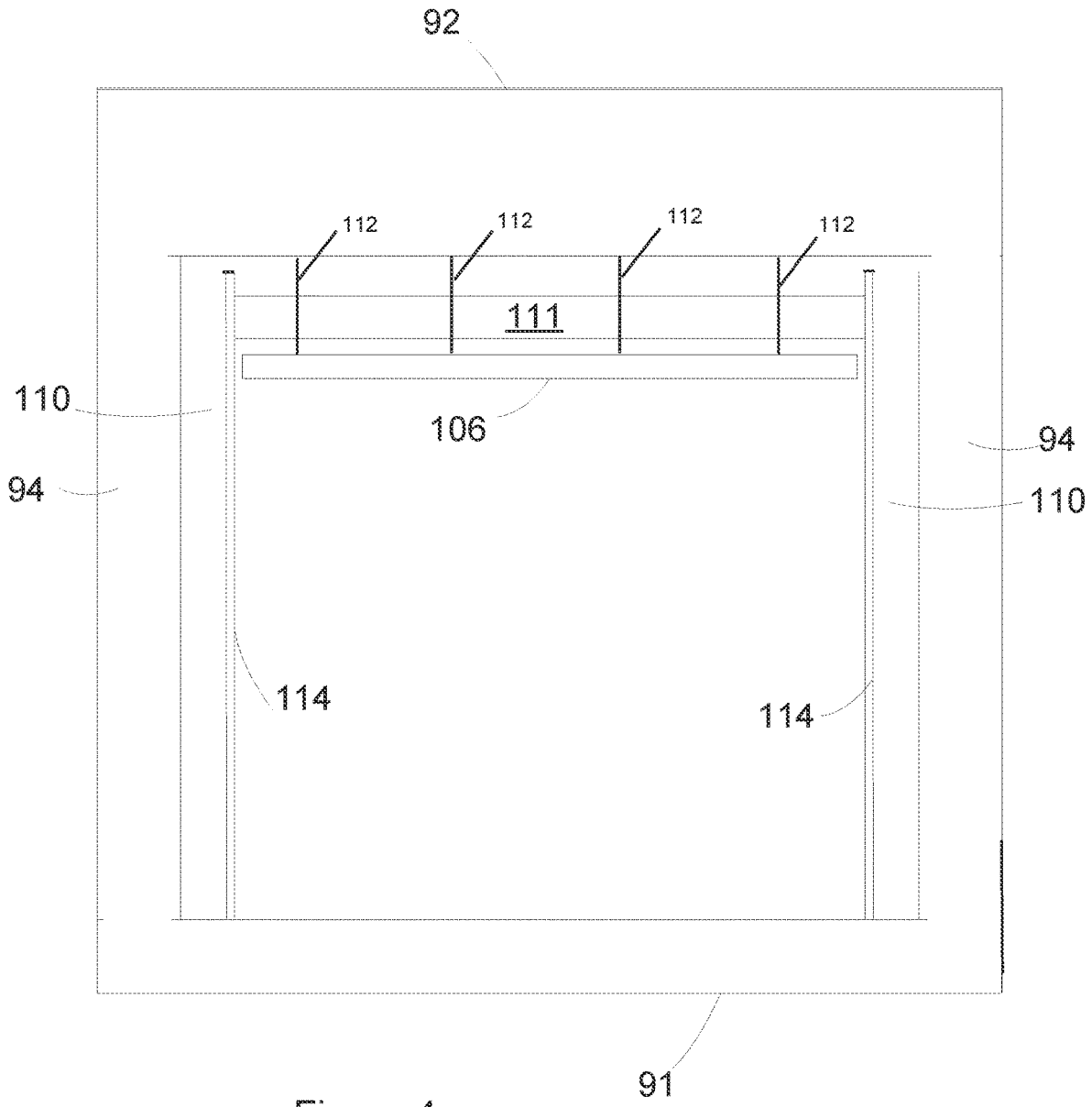
FIG. 4 depicts a front view of an alternative interior building construction assembly, in accordance with at least one example embodiment.

FIG. 2 depicts an isometric view of the construction assembly of FIG. 1, in accordance with at least one example embodiment, and FIGS. 3 and 4 depict front views of construction assemblies such as the construction assembly of FIG. 1.

The airspace portions 110 are shown in FIG. 2. Similarly as with the airspace portions 110 between the stud walls 114 and the base building walls 94, in some embodiments, the airspace portions 110 between the upper base building slab 92 and the top surfaces of the stud walls 114 also comprise at least 1 inch, and in some embodiments, can range between 0.25 inches to 10 feet. In other examples, the gap may be even larger, well over 40 feet, depending on the size of the base building. Such airspace portions 110 provide for the avoidance of vertical and horizontal stresses and strains to be transmitted to the drywall partitions, stud walls 114, due to inter-story drift.

FIG. 3 shows a front view of a construction assembly, wherein the finish ceiling 106 is not attached to the upper base building slab 92, but is instead attached to one or more of the interior surfaces of the stud walls 114 and/or the joist structure 108.

FIG. 4 shows a front view of a construction assembly, wherein the finish ceiling 106 is suspended with suspension elements 112 extending through gaps between the plurality of joists 111, up to and affixing the finish ceiling to the upper base building slab 92.

In one embodiment, a method for building a construction assembly within a base building structure is provided. The construction assembly may comprise the construction assembly 100, and the base building structure may comprise the base building structure 90, as described with reference to FIGS. 1-4.

The method comprises affixing bottom surfaces of a plurality of stud walls to a lower base building slab, and leaving a gap between the plurality of stud walls and the base building walls.

Next, the method comprises affixing a joist structure to interior surfaces of the plurality of stud walls. At least one joist extends within a frame of the joist structure, and the frame is affixed to the interior surfaces of the plurality of stud walls, thereby providing lateral support to the stud walls.

The method may further include hanging a finish ceiling via hanging elements from an upper base building slab, wherein the hanging elements are not attached to the joist structure. The hanging elements may extend through gaps between joists, as described with reference to FIGS. 1 and 4. Alternatively, the method may include affixing the finish ceiling to one or both of the stud walls and the joist structure, and not the base building slab, as depicted in FIG. 3.

The disclosed non-contact construction and associated methods provide for superior interior framing to mitigate the effects of building drift, all the while without compromising the stability of the interior construction structure.

Thus, while traditional framing comprises interior walls spanning from building slab to building slab, being rigidly connected to the slabs to prevent the structure from falling over, the present structure disconnects or decouples the walls from the upper base building slab and the base building walls, allowing for additional movement of the structure while continuing to provide adequate support to prevent the interior structure walls from collapsing.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims, along with the full scope of equivalents to which such claims are entitled. It is also to be understood that the terminology used herein is for the purpose of describing particular embodiments only, and is not intended to be limiting.

What is claimed is:

1. An interior building construction assembly to be positioned within a base building comprising:

a plurality of side walls, each of the plurality of side walls comprising an exterior surface, an interior surface, a bottom end, and a top end opposite the bottom end, the bottom end being connected to a lower base building slab of the base building and the top end being free; and a lateral support structure comprising at least one lateral joist extending between two of the plurality of sidewalls.

2. The interior building construction assembly of claim 1, further comprising:

a finish ceiling configured to be suspended from an upper base building slab and positioned below the lateral support structure.

3. The interior building construction assembly of claim 2, wherein the finish ceiling does not contact the lateral support structure or the plurality of side walls.

4. The interior building construction assembly of claim 1, wherein the lateral support structure comprises a frame and a plurality of joists extending between the frame.

5. The interior building construction assembly of claim 4, wherein the frame of the lateral support structure is affixed to the interior surface of the plurality of side walls.

6. The interior building construction assembly of claim 1, wherein the interior building construction assembly is configured to be positioned within the base building.

7. The interior building construction assembly of claim 5, wherein the bottom end of each of the plurality of side walls is affixed to a lower base slab of the building structure, and an airspace portion is defined between the exterior surfaces of each of the plurality of side walls and the base walls.

8. The interior building construction assembly of claim 7, wherein the airspace portion is a gap at least 1 inch wide.

9. The interior building construction assembly of claim 1, wherein the exterior surfaces and the top ends of the plurality of sidewalls are decoupled from the base building structure.

10. The interior building construction assembly of claim 1, wherein the at least one lateral support element comprises a joist.

11. A building construction system, comprising:

a base building structure formed by a lower base building slab, an upper base building slab, and a plurality of base building wall slabs, the base building structure defining an interior therein;

an interior building construction assembly positioned within the interior and comprising:

a plurality of side walls, each of the plurality of side walls comprising a bottom end and a top end opposite the bottom end, and an exterior surface and an interior surface;

a lateral support structure affixed to at least one of the interior surfaces of the plurality of side walls; and a finish ceiling configured to be suspended from the upper base building slab and positioned below the lateral support structure;

wherein the bottom ends of the plurality of side walls connect to the lower base building slab, wherein a gap is defined between the exterior surfaces of the plurality of side walls and the plurality of base walls of the building, thereby decoupling the plurality of side walls from the plurality of base walls.

12. The building construction system of claim 11, wherein the finish ceiling does not contact the lateral support structure or the plurality of side walls.

13. The building construction system of claim 11, further comprising:

a finish ceiling affixed to one or both of the lateral support structure and the plurality of side walls.

14. The building construction system of claim 11, wherein the lateral support structure comprises a frame and a plurality of joists extending between the frame.

15. The building construction system of claim 14, wherein the frame of the lateral support structure is affixed to the interior surface of the plurality of side walls.

16. The building construction system of claim 14, wherein the gap is at least 1 inch wide.

* * * * *